US007726415B1

(12) United States Patent
Tipton et al.

(10) Patent No.: US 7,726,415 B1
(45) Date of Patent: Jun. 1, 2010

(54) FIXED CUTTER DRILL BIT

(75) Inventors: Robert George Tipton, Conroe, TX (US); Carl W. Keith, Houston, TX (US); Gerald A. Strenk, Jr., Spring, TX (US)

(73) Assignee: OTS International, Inc., Conroe, TX (US)

( * ) Notice: Subject to any disclaimer, the term of this patent is extended or adjusted under 35 U.S.C. 154(b) by 318 days.

(21) Appl. No.: 11/399,709

(22) Filed: Apr. 6, 2006

Related U.S. Application Data

(60) Provisional application No. 60/669,052, filed on Apr. 7, 2005.

(51) Int. Cl.
*E21B 12/02* (2006.01)
*E21B 10/26* (2006.01)

(52) U.S. Cl. ..... 175/39; 175/385; 175/406

(58) Field of Classification Search ..... 175/406, 175/385, 389, 390, 391, 415, 417, 418, 419, 175/420, 420.1, 429, 428, 431, 432, 39; 76/108.1, 108.2, 108.4
See application file for complete search history.

(56) References Cited

U.S. PATENT DOCUMENTS 4,515,227 A * 5/1985 Cerkovnik ..... 175/65
4,618,010 A * 10/1986 Falgout et al. ..... 175/430
4,911,254 A 3/1990 Keith
5,090,492 A 2/1992 Keith
5,099,929 A 3/1992 Keith et al.
5,238,075 A 8/1993 Keith et al.
5,265,685 A * 11/1993 Keith et al. ..... 175/431
5,346,025 A 9/1994 Keith et al.
5,549,171 A 8/1996 Mensa-Wilmot et al.
5,551,522 A 9/1996 Keith et al.
5,582,261 A 12/1996 Keith et al.
5,592,996 A 1/1997 Keith et al.
5,607,024 A 3/1997 Keith et al.
5,607,025 A 3/1997 Mensa-Wilmot et al.
5,737,980 A 4/1998 Keith et al.
5,906,246 A 5/1999 Mensa-Wilmot et al.
5,937,958 A 8/1999 Mensa-Wilmot et al.
6,148,937 A 11/2000 Mensa-Wilmot et al.
6,164,394 A 12/2000 Mensa-Wilmot et al.
6,408,958 B1 * 6/2002 Isbell et al. ..... 175/431
6,564,886 B1 5/2003 Mensa-Wilmot et al.
6,568,492 B2 5/2003 Thigpen et al.
6,659,199 B2 * 12/2003 Swadi ..... 175/57
6,729,420 B2 5/2004 Mensa-Wilmot et al.
6,904,983 B2 6/2005 Thigpen et al.
6,918,455 B2 7/2005 Meyers et al.
6,926,099 B2 8/2005 Thigpen et al.
2001/0047890 A1 12/2001 Meyers et al.

(Continued)

*Primary Examiner*—Kenneth Thompson
(74) *Attorney, Agent, or Firm*—John G. Fischer, Esq.; Mark D. Perdue, Esq.; Storm LLP

(57) ABSTRACT

The fixed cutter drill bit disclosed utilizes a unique piloting section and reaming section carefully designed to impart several specific operational advantages. In the piloting section, cutting structures have been arranged so as to create offsetting cutting forces that result in a net zero imbalance during operation. Furthermore, the piloting section utilizes carefully placed shock studs which aid in protecting the primary cutting structure. In addition, the location of the fluid supply nozzles on the body of the reamer section serves to indicate the occurrence of a catastrophic cutting structure failure below the pilot gage.

9 Claims, 18 Drawing Sheets

U.S. PATENT DOCUMENTS

2002/0121393 A1 9/2002 Thigpen et al.
2004/0149495 A1 8/2004 Thigpen et al.
2004/0188149 A1 9/2004 Thigpen et al.

* cited by examiner

FIXED CUTTER DRILL BIT

CROSS-REFERENCE TO RELATED APPLICATIONS

This application claims the benefit of U.S. Provisional Patent Application No. 60/669,052, filed Apr. 7, 2005 (entitled "A Novel Fixed Cutter Drill Bit"), and applicant incorporates the entirety of that provisional patent application herein by reference.

BACKGROUND OF THE INVENTION

The Field of the Invention

This invention relates generally to drill bits (and related technologies) of the type used to drill through layers of material, including those comprising rock formations such as those bearing oil and other fossil fuels. As an example, the invention is concerned with fixed cutter drill bits of the type using polycrystalline diamond cutting elements protruding from the face of the bit.

A Challenging Problem: the Selection and Design of Effective Drill Bits

In drilling a borehole in the earth such as for the recovery of oil or for other purposes, many different types of drill bits have been used. The choice of the appropriate type of bit to be used (and the specifics associated with its design) depends upon many factors. One important factor to be taken into consideration is the range of hardnesses that will be encountered during the drilling that takes place through layers of differing formation hardnesses.

The cost of drilling a borehole is proportional to the length of time it takes to drill the borehole to the desired location. The drilling time, in turn, is greatly affected by the number of times the drill bit must be changed in order to reach the target. This is so because each time the bit is changed, the entire drill string, which may be miles long, must be retrieved from the borehole section by section.

Furthermore, once the drill string has been retrieved and the new bit installed, the bit must be lowered to the bottom of the borehole on the drill string which must be reconstructed, again section by section.

The length of time that a drill bit is kept in the hole before the drill string must be tripped and the bit changed depends upon a variety of factors. These factors include the bit's rate of penetration, its durability (or ability to maintain a high or acceptable rate of penetration), and its ability to achieve the objectives outlined by the drilling program. Operational parameters, such as weight on bit, have a large influence on the bit's rate of penetration.

Thus, this process, known as "tripping" the drill string, requires considerable time, effort and expense. Accordingly, it is always desirable to employ drill bits that will drill faster and longer and that are usable over a wider range of differing formation hardnesses.

BRIEF SUMMARY OF THE INVENTION

The novel fixed cutter drill bit disclosed in this specification utilizes a unique piloting section and reaming section carefully designed to impart several specific operational advantages.

In the piloting section, cutting structures have been arranged so as to create offsetting cutting forces that result in a net zero imbalance during operation. Furthermore, the piloting section utilizes carefully placed shock studs which aid in protecting the primary cutting structure against over-engagement, axial, or lateral impact (as well as assisting in maintaining or restoring bit stability).

In addition, the location of the fluid supply nozzles on the body of the reamer section serves to indicate catastrophic cutting structure failure below the pilot gage. In the event formation breaches the reamer blades and the cutting structure is lost, the formation will continue to eat into the blade body. As the formation advances, it will eventually block the fluid flow from returning up the annulus of the drill string. This will cause an increase in fluid pressure, indicating the blockage. This signal indicates the need to retrieve the bit before a total breakdown of the bit occurs.

Other attractive features of the invention will be readily apparent to those of ordinary skill in the art, and the scope of the invention should therefore not be discerned from the descriptive material in the specification, but, rather, from the claims ultimately allowed in this patent.

BRIEF DESCRIPTION OF THE SEVERAL VIEWS OF THE DRAWINGS

FIG. 1A is not drawn to scale.

FIG. 4A is not drawn to scale.

FIG. 8 is not drawn to scale.

Unless otherwise clearly indicated in the figures themselves, or from the context of corresponding language in the specification, all figures are drawn to scale.

DETAILED DESCRIPTION OF THE INVENTION

This application claims the benefit of U.S. Provisional Patent Application No. 60/669,052, filed Apr. 7, 2005 (entitled "A Novel Fixed Cutter Drill Bit"), and applicant incorporates the entirety of that provisional patent application herein by reference.

The Selection and Design of Effective Drill Bits

In drilling a borehole in the earth such as for the recovery of oil or for other purposes, many different types of drill bits have been used. The choice of the appropriate type of bit to be used (and the specifics associated with its design) depends upon many factors. One important factor to be taken into consideration is the range of hardnesses that will be encountered during the drilling that takes place through layers of differing formation hardnesses.

Different types of bits work more or less efficiently against different formation hardnesses. For example, roller cone bits are efficiently and effectively used in drilling through formation materials that are of medium to hard hardness. Fixed cutter bits can be applied to hard material formations using natural diamond granules embedded in the matrix of the bit body at its face.

Replaceable and adjustable blades protruding from the body of the bit, each of which comprises radially spaced sections of diamond-embedded cutting elements, can improve the centering stability of the rotating bit.

Fixed cutter drill bits, particularly those with natural diamond, small cutting elements, or large numbers of cutting elements, are not believed to be particularly well suited for use in softer formations because they tend to drill at lower penetration rates. In addition, their drilling surfaces, containing the diamond-embedded cutting elements, may be easily clogged with less brittle formation material. As a result, when drilling from a hard formation material and into a softer formation material, the penetration rate may decrease.

When drilling formation materials in the soft to medium range, a bit may utilize radial sets of cutting elements mounted within supports so as to protrude from the face of the bit. This kind of drilling cutter may be configured to employ a shearing action to drill through the formation material.

Because the cost of drilling a borehole is a direct function of the length of time it takes to reach the depth desired, it is always desirable to have bits which drill faster and longer and which are usable over a wider range of differing formation material hardnesses. Thus, there exists a need for a bit which is suitable for use in drilling so that the drill string need not be pulled (or "tripped") when the hardness of the material changes.

A Novel Bit Design

Figure 1:
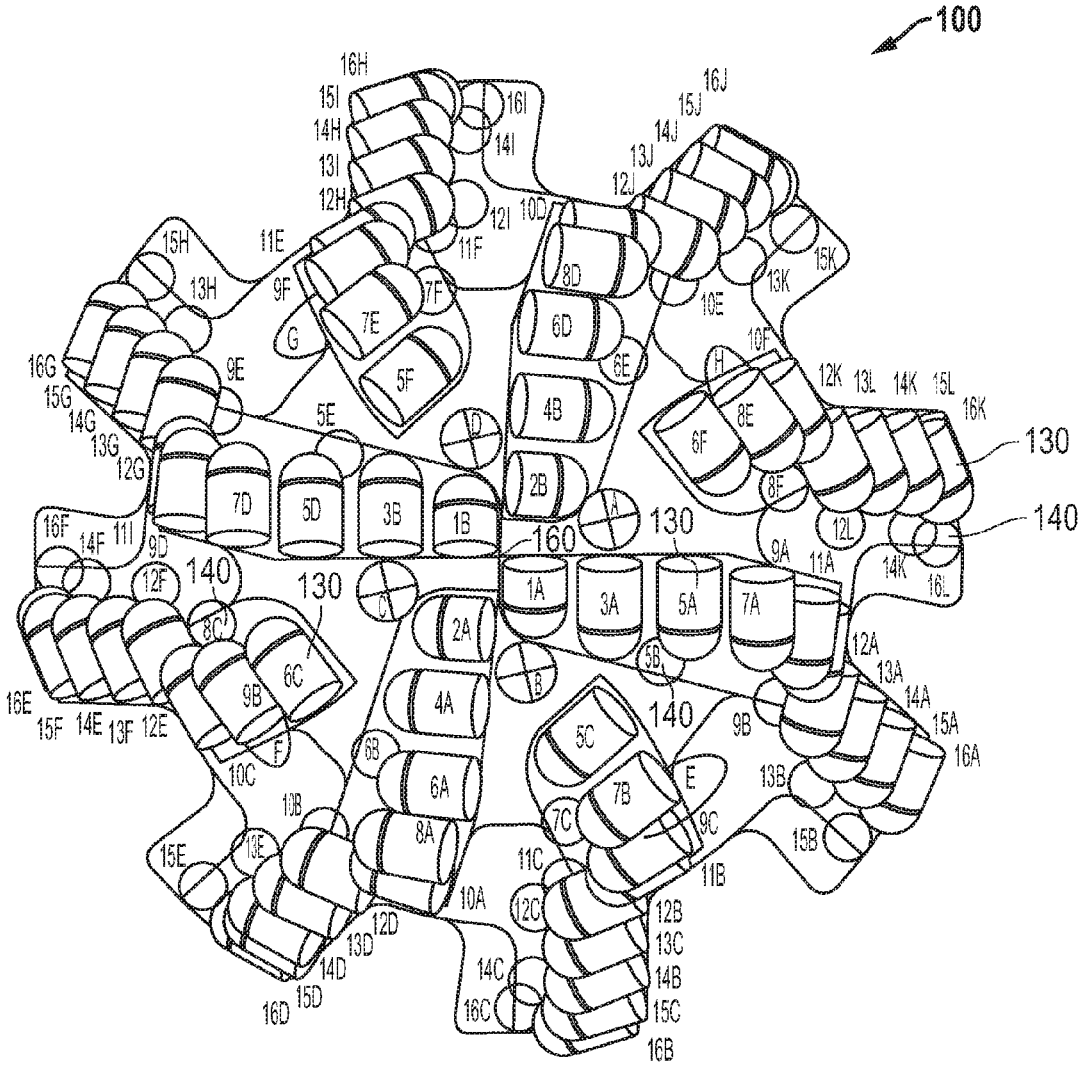
FIG. 1 depicts a "face" view of a novel drill bit that includes some of the patentable features of the present invention.

Referring, now, to the figures, and, in particular, to FIG. 1, there is shown a "face" view of a drill bit 100 that includes some of the patentable features of the present invention.

In this view, a cutting structure is defined on a piloted profile. This cutting structure is arranged so as to create offsetting cutting forces that result in a net zero imbalance. This is accomplished by cutter redundancies that are diametrically opposed to each other for every radial cutting position and whose physical and positioning attributes are identical. The pilot section 110 of the bit profile includes cutter positions 1 through 11 with at least two cutters (for example, cutters 1A, 1B; cutters 2A, 2B; etc.) 130 in each radial position. The cutter elements 1A, 1B, 2A, 2B, etc., or cutters, are collectively referenced herein as cutting elements 130 or cutters 130.

The circular (i.e., hemispherical) objects 140 that trail the cutters are not part of the primary cutting structure and see no cutting force. These protrusions, known as shock studs 1-16 (or, collectively, shock studs 140), may carry passive cutting elements and extend towards, but not to, the cutting profile in a tracking path of their respective cutter 130 and aid in protecting the primary cutting structure against over-engagement, axial, or lateral impact and assist in maintaining or restoring bit stability.

As a review of the cutting structure continues to the reaming section 120 of the profile, cutter positions 12 through 16 are defined and located with the same attributes as the pilot cutter positions described above. These positions are fully redundant and offer the maximum cutter density possible for each cutter location.

Thus, in FIG. 1, for example, the cutters 1-16, 130, and various corresponding shock studs 1-16, 140, are mounted on blades 102 as follows:

(a) cutters 1A, 3A, 5A, 7A, 9A, 11A, 12A, 13A, 14A, 15A, and 16A (with corresponding shock studs 5B, 9B, 13B, and 15B);

(b) cutters 6F, 8E, 10F, 12K, 13L, 14K, 15L, and 16K (with corresponding shock studs 8F, 12L, 14L, and 16L);

(c) cutters 2B, 4B, 6D, 8D, 10D, 12J, 13J, 14J, 15J, and 16J (with corresponding shock studs 6E, 10E, 13K, and 15K);

(d) cutters 5F, 7E, 9F, 11E, 12H, 13I, 14H, 15I, and 16H (with corresponding shock studs 7F, 11F, 12I, 14I, and 16I);

(e) cutters 1B, 3B, 5D, 7D, 9D, 11D, 12G, 13G, 14G, 15G, and 16G (with corresponding shock studs 5E, 9E, 13H, and 15H);

(f) cutters 6C, 8B, 10C, 12E, 13F, 14E, 15F, and 16E (with corresponding shock studs 8C, 12F, 14F, and 16F);

(g) cutters 2A, 4A, 6A, 8A, 10A, 12D, 13D, 14D, 15D, and 16D (with corresponding shock studs 6B, 10B, 13E, and 15E); and (h) cutters 5C, 7B, 9C, 11B, 12B, 13C, 14B, 15C, and 16B (with corresponding shock studs 7C, 11C, 12C, 14C, and 16C).

It will be noted that, in the two-stage profile shown in FIG. 1, one or more shock studs 140 provide proximate support for every major cutter position 1-16 but not necessarily every cutter location 1A, 1B, 2A, 2B, 3A, etc. In this respect, the design represents a practical optimum as the use of an excessive number of studs 140 creates excessive frictional drag and impedes the penetration rate.

Figure 8:
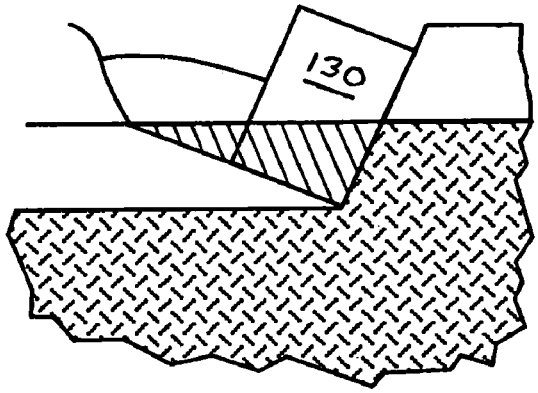
FIG. 8 depicts the engagement of a single cutter/cutting element.

Generally speaking, and all other things being equal, a larger drill bit 100 has a lower rate of penetration than a smaller drill bit 100. One advantage to having pilot 110 and reamer 120 sections on the bit 100, as generally described above, is an improved rate of penetration resulting from the initial drilling of a smaller radius borehole by the pilot portion 110 followed by the larger radius reamer portion 120. This improved rate of penetration results from the coordinated efforts of the piloting section 110 and the reaming section 120 in sharing the work done by each and every cutting element 130 as it axially, longitudinally and rotationally drives its way through the earthen formation (see FIG. 8).

Figure 1A:
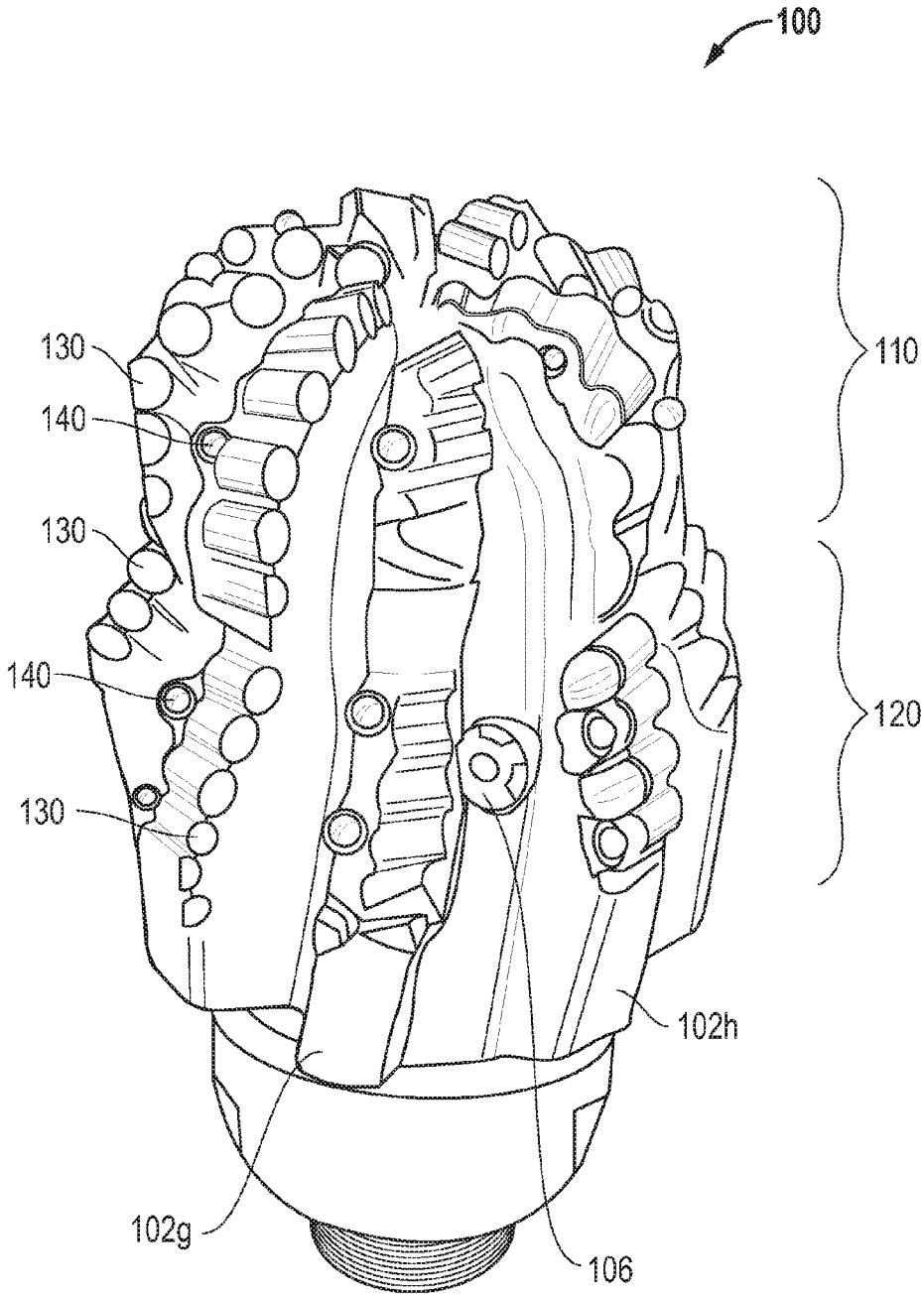
FIG. 1A depicts an isometric view of the novel drill bit shown in FIG. 1.

Returning, now, to FIG. 1A, there is shown an isometric view (not to scale) of the drill bit 100. The figure is provided because it graphically and dramatically demonstrates the contrast between the piloting 110 and reaming 120 sections of the instant novel bit 100.

Figure 2:
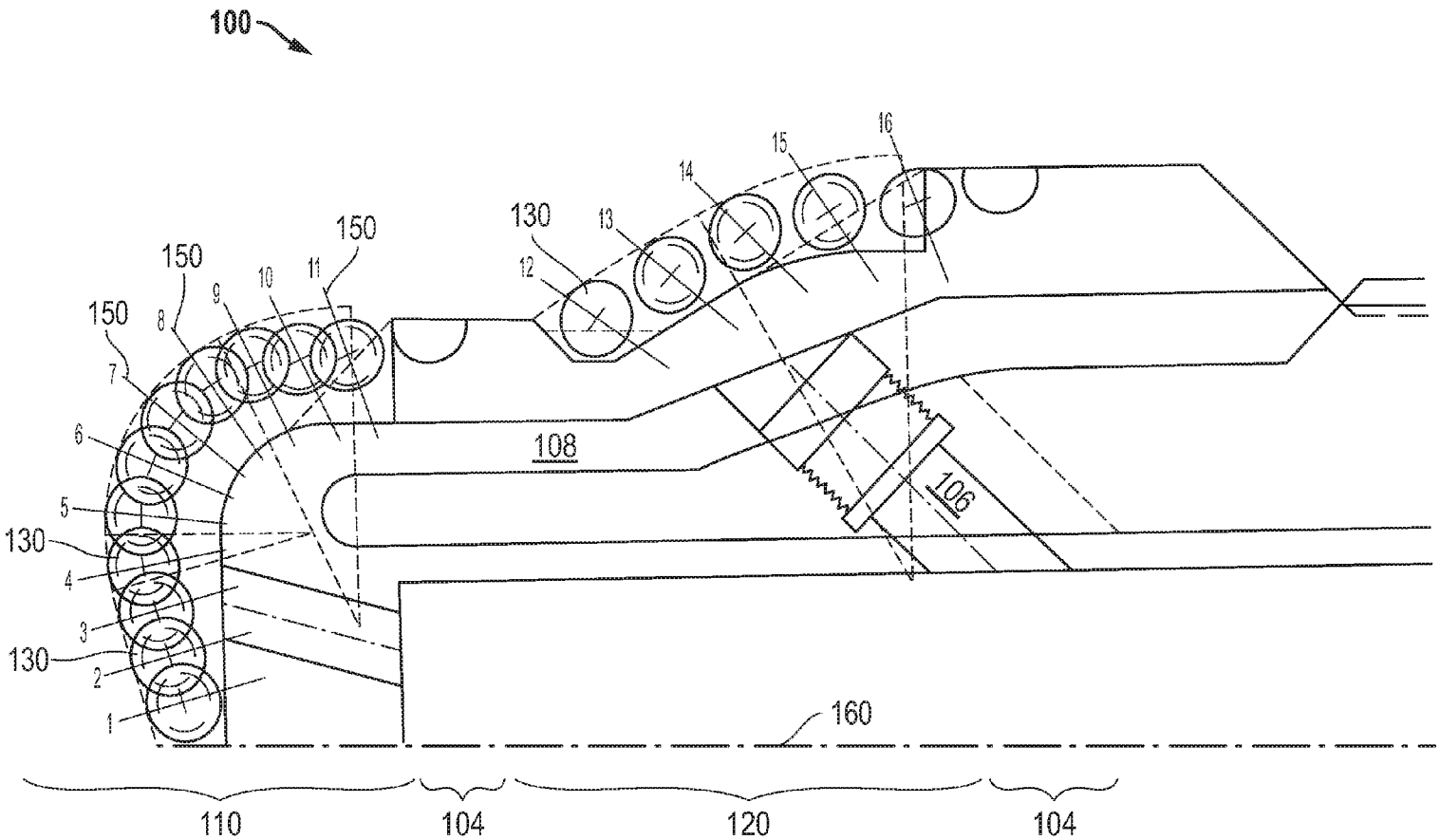
FIG. 2 depicts a quarter section rotated profile of the bit shown in FIG. 1.

FIG. 2 depicts a quarter section profile of the bit 100 shown in FIG. 1.

In this view, all of the cutter positions 1-16 are seen rotated in section. This illustrates the entire cutting structure and the relative positioning of adjacent cutter positions 1-16. The pilot 110 is seen with adjacent cutters 130 that overlap across the profile to provide full axial coverage of the pilot 110.

Although a variety of profiles, layouts and transitions might be used for a given application, the bit 100 profile transitions to a steep trajectory on the reamer portion 120. This profile configuration eliminates the need for adjacent cutter overlap on the reamer 120, allowing for maximum cutter 130 redundancy and density. In the axial or drilling direction, the reamer 120 is protected by the projected axial overlap of the reamer cutters vs. physical overlap.

This figure also makes abundantly apparent some of the unique operative characteristics of the invention. Key in this regard is the highly defined "stair step" bottom hole profile which is defined as a result of the action of the cutters 130 in the reaming section 120. That is, as is apparent from FIG. 2, as the bit 100 proceeds in the axial direction, a portion of the earthen formation engages cutter 12; an adjacent portion slides directly past cutter 12 and is directly engaged by cutter 13; and so on. This sliding engagement ultimately imparts a distinctive "stair step" bottom-hole profile along the entire reaming section 120, a profile which imparts significant operational stability to the entire drilling structure.

In addition, it will be noted that greater numbers of cutter elements 130 are placed at critical cutter element locations (i.e., at critical locations along the bit's cutting profile) featuring greater amounts of physical stress or criticalities important to the bit's overall structural stability. For example, cutter element locations 5-11 feature four cutter elements, whereas cutter element locations 1-4 feature only two cutter elements. Similarly, cutter element locations 12-16 feature eight cutter elements to impart the structural stability referenced hereinabove.

Furthermore, for example, in these critical cutter element locations, the shock stud ratio could vary widely due, for example, to the characteristics of the earthen formation, the operational limitations of the rig, the desired survivability of the drill body (for future use), and other factors. For example, in a relatively firm formation (e.g., sandstone, limestone), featuring a relatively abrasive operating environment, it may well be advantageous to utilize a shock stud ratio of at or about fifty percent (i.e., at or about one shock stud for every two cutter elements) as shown in FIG. 1. This, again, represents a balancing of the benefits of additional structural stability versus the costs of additional frictional drag and penetration rate impedance, among other factors (as, e.g., referenced hereinabove).

Figure 3:
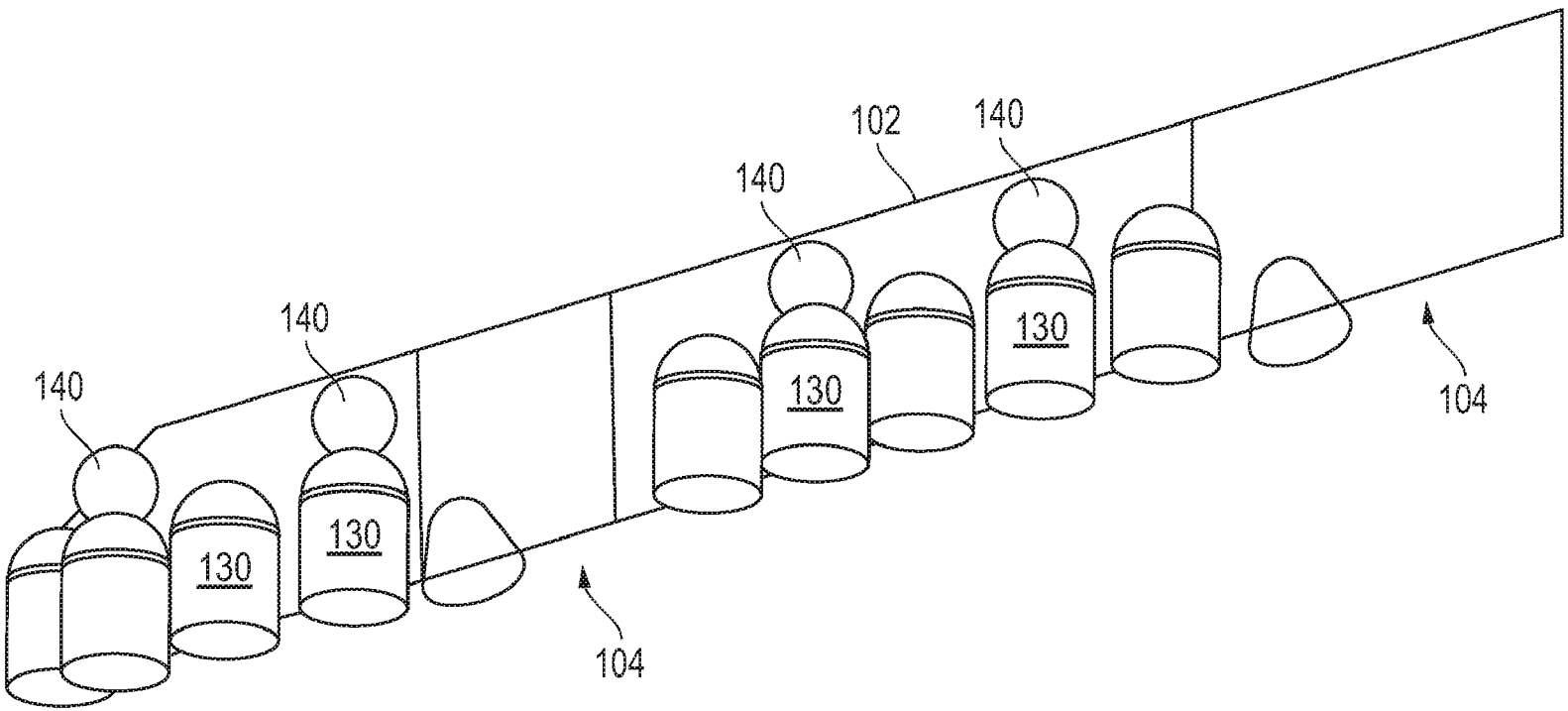
FIG. 3 depicts a side detail view of a single continuous cutting blade from the bit in FIGS. 1 and 2.

Turning, now, to FIG. 3, there is shown a side detail view of a single continuous cutting blade 102 from the bit 100 shown in FIG. 1 and FIG. 2.

Each cutting structure group (i.e., pilot and reamer) is followed by a gage section 104 that corresponds to that group and maintains the bit diameter for that section through the course of drilling. The blade 104 is shown canted back, although the blades 104 may be oriented forward, spiraled, straight vertical or in other configurations.

Figure 4:
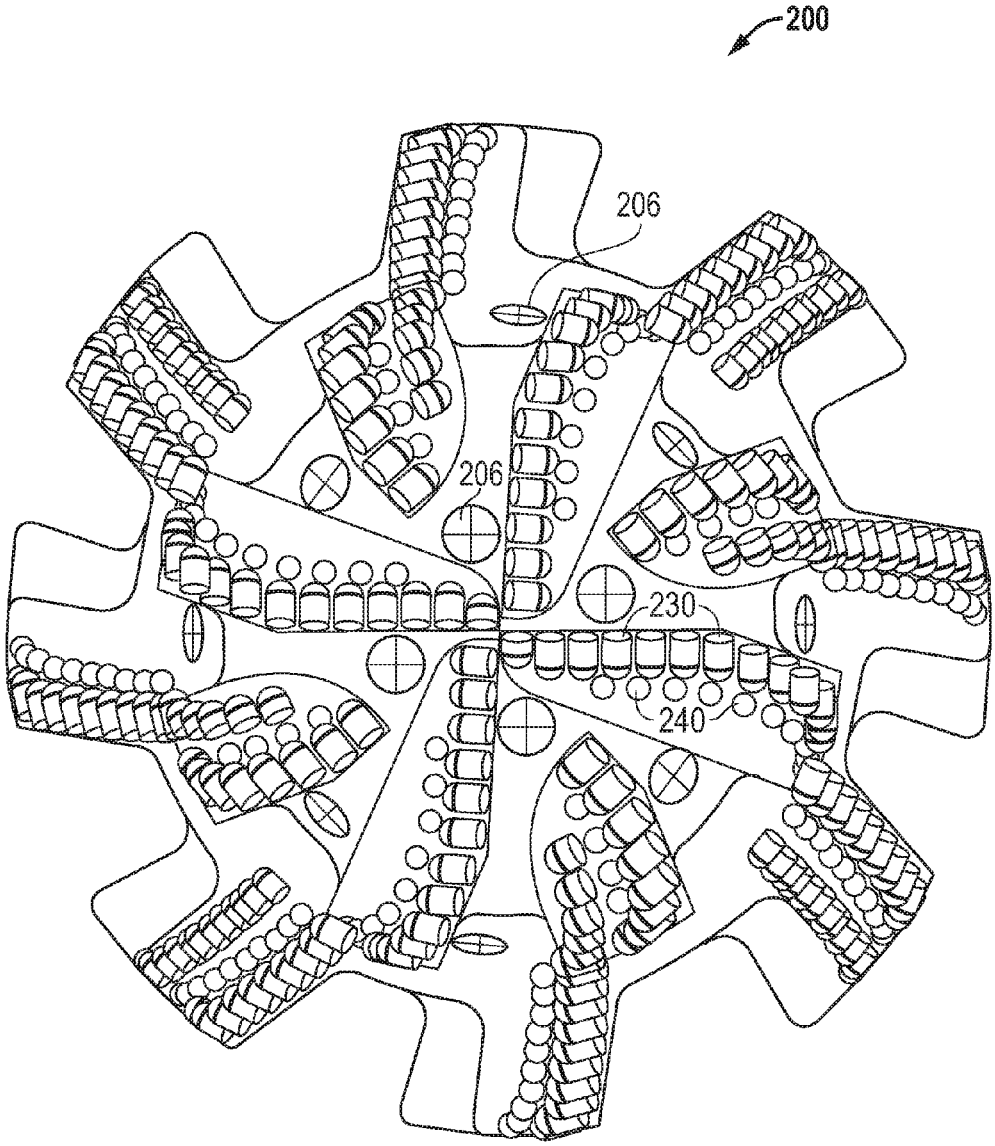
FIG. 4 depicts a "face" view of an alternate configuration with the novel features described in FIG. 1.

FIG. 4 shows a "face" view of an alternative embodiment of the invention, a novel bit 200 featuring additional novel benefits of the invention.

In this view, the shock studs 1-22, 240 are nested between some groups of cutters 230 (i.e., cutter groups) so as to provide impact protection to multiple cutters 1-22, 230 in close proximity to the nested stud 240. These studs 1-22, 240 are not an active part of the primary cutting structure but do offer protection from impact and aid in the restoration or maintenance of bit stability.

Figure 4A:
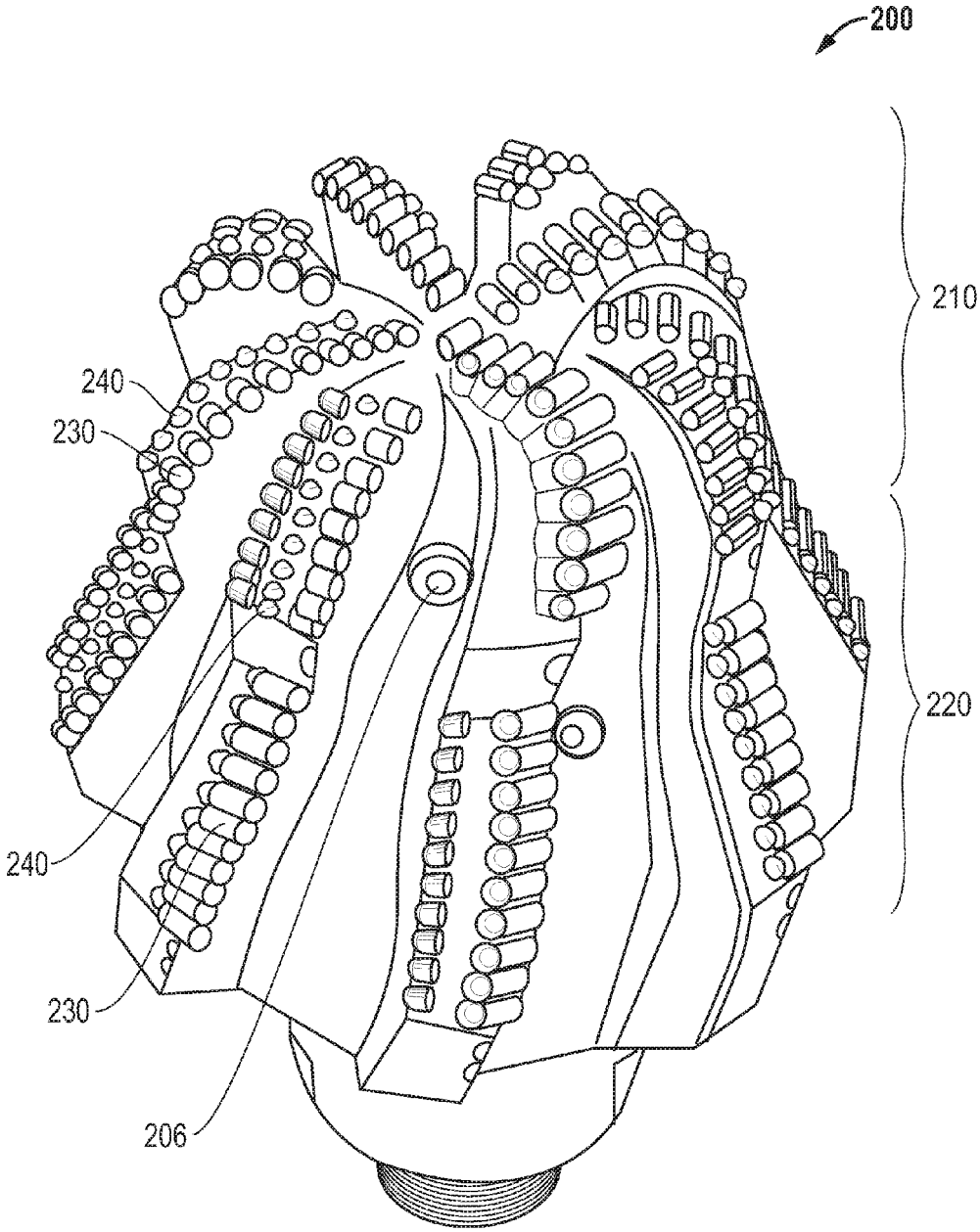
FIG. 4A depicts an isometric view of the alternate configuration shown in FIG. 4.

Referring, now, to FIG. 4A, there is shown an isometric view (not to scale) of the drill bit 200. The figure is provided because it graphically and dramatically demonstrates the contrast between the piloting 210 and reaming 220 sections of the instant novel bit 200.

Figure 5:
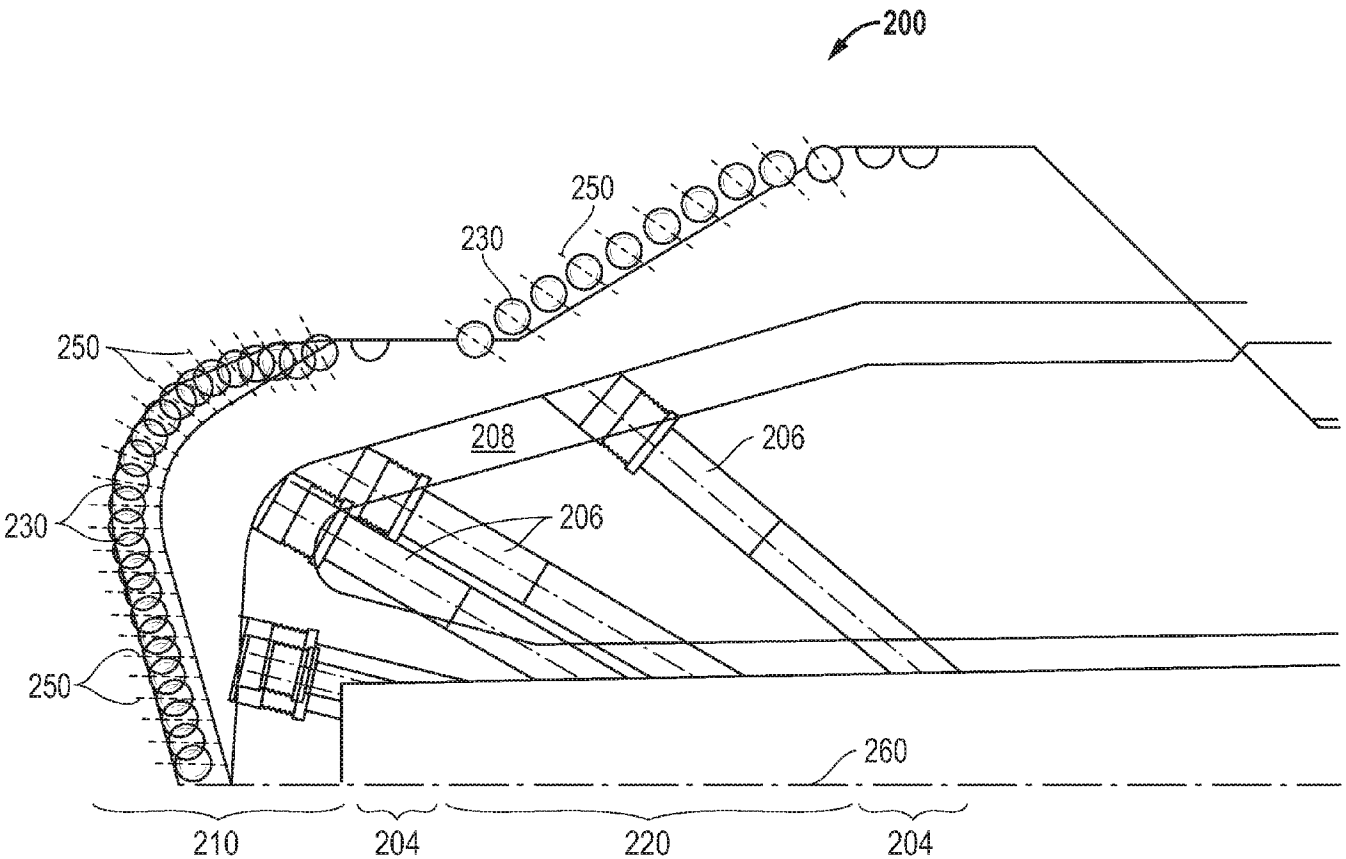
FIG. 5 depicts a quarter section rotated profile of the bit shown in FIG. 4.

Turning, now, to FIG. 5, there is shown a quarter section profile of the bit 200 shown in FIG. 4. Other novel features of the invention 200 are seen in this view and in FIG. 2. The cutter orientation lines 250 demonstrate that the orientation of each cutter axis and cutting tip has been intentionally and purposely rotated into a more axial alignment with respect to the bit axis 260 or drilling direction. Reorienting the cutting tip of each cutter 1-22 improves cutting efficiency and cutter cooling by maximizing cutting relief behind the cutting tip in the direction of drilling. This technique may be used on all or part of the cutting profile to enhance cutting efficiency.

In this, and in FIG. 2, another feature of the invention is seen. The location of the fluid supply nozzles 206 on the body of the reamer section 220 serve to indicate catastrophic cutting structure failure below the pilot gage 204. In the event formation breaches the reamer blades 202 and the cutting structure is lost, this formation will continue to eat into the blade body 208. As this formation advances, it will eventually block the fluid flow from returning up the annulus of the drill string. This will cause an increase in fluid pressure, indicating the blockage. This signal indicates the need to retrieve the bit before a total breakdown of the bit 200 occurs.

Figure 6:
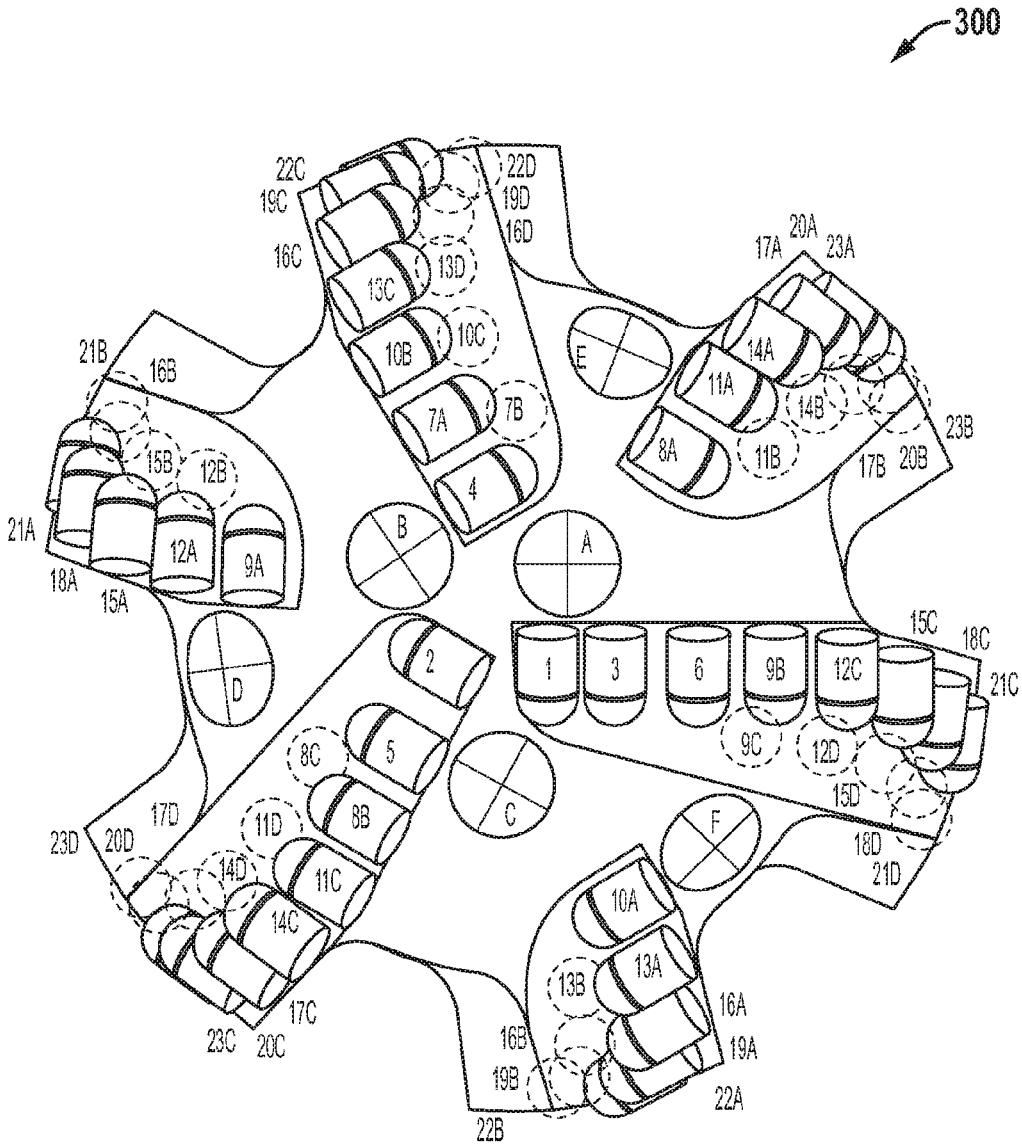
FIG. 6 depicts a face view of a drill bit that does not include the features of the present invention.
Figure 7:
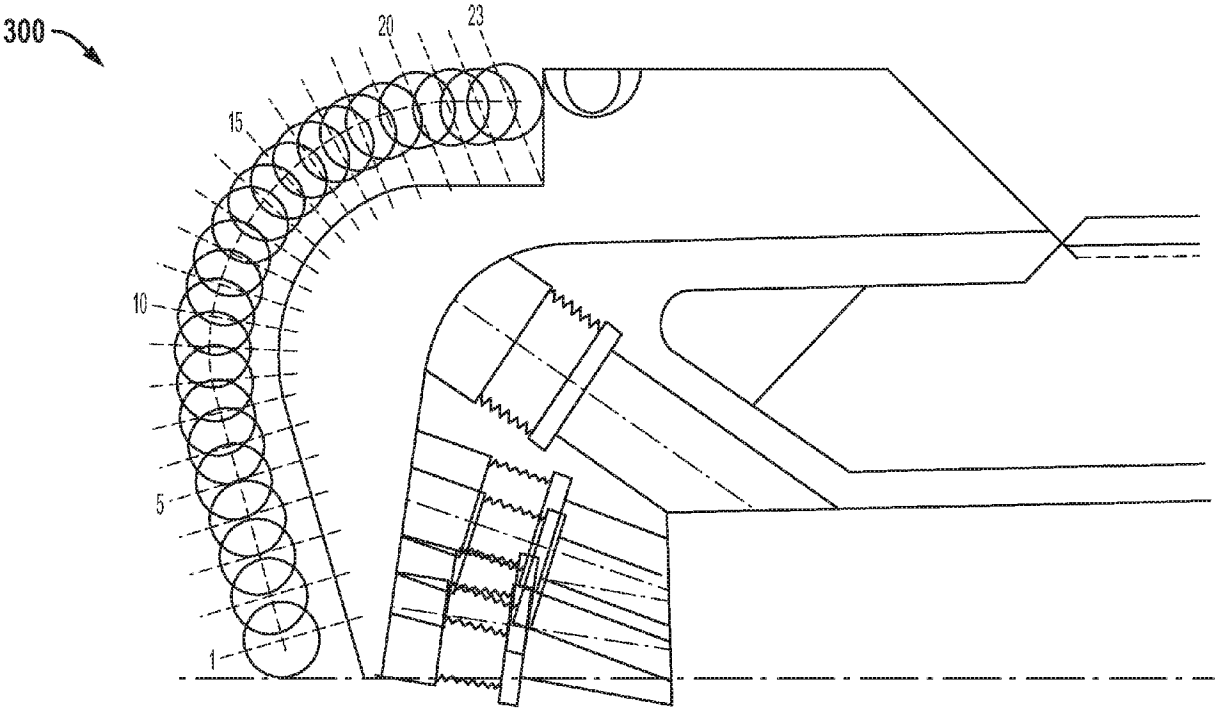
FIG. 7 depicts a quarter section rotated profile of a drill bit that does not include the features of the present invention.

Finally, FIG. 6 and FIG. 7 show a face and quarter section rotated profile of a bit 300 that does not include the features of the present invention, preventing it from achieving the stability and enhanced performance necessary to successful and efficiently drill formations like that of bits 100, 200 that incorporate the advanced technological features as described in this invention.

Figure 9:
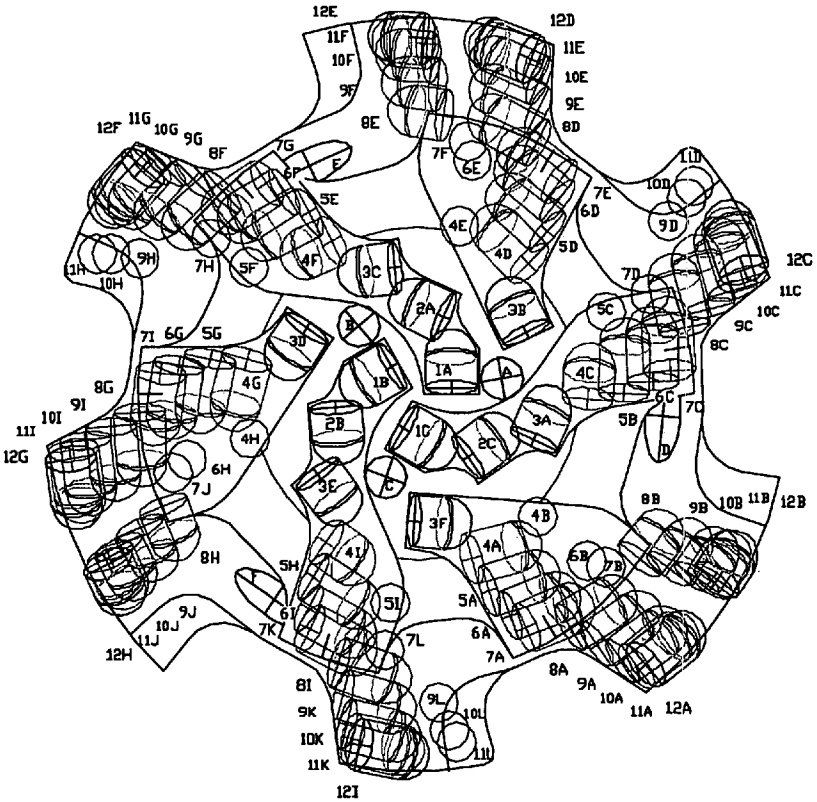
FIG. 9 depicts a face view of another embodiment of the novel drill bit disclosed and claimed herein.
Figure 10:
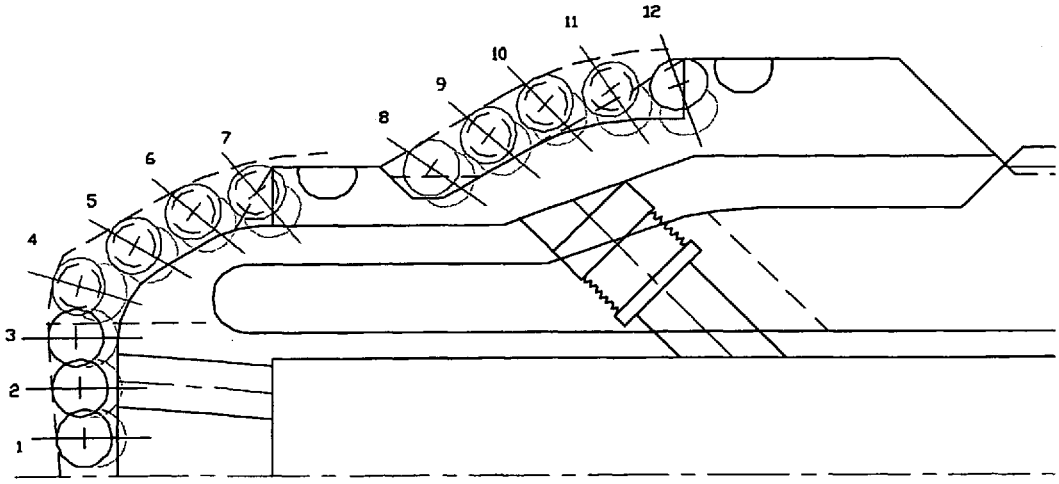
FIG. 10 depicts a quarter section rotated profile of the novel drill bit embodiment depicted in FIG. 9.

Turning, now, to FIG. 9, this figure depicts a face view of another embodiment of the novel drill bit disclosed and claimed herein. FIG. 10 depicts a quarter section rotated profile of the novel drill bit embodiment depicted in FIG. 9.

In FIG. 9 and FIG. 10, the reader will note that the "stair step" profile referenced hereinabove makes its appearance not only in the reaming section of the bit, but, in addition, as is particularly apparent in FIG. 10, in the pilot section of the drill bit.

Figure 11:
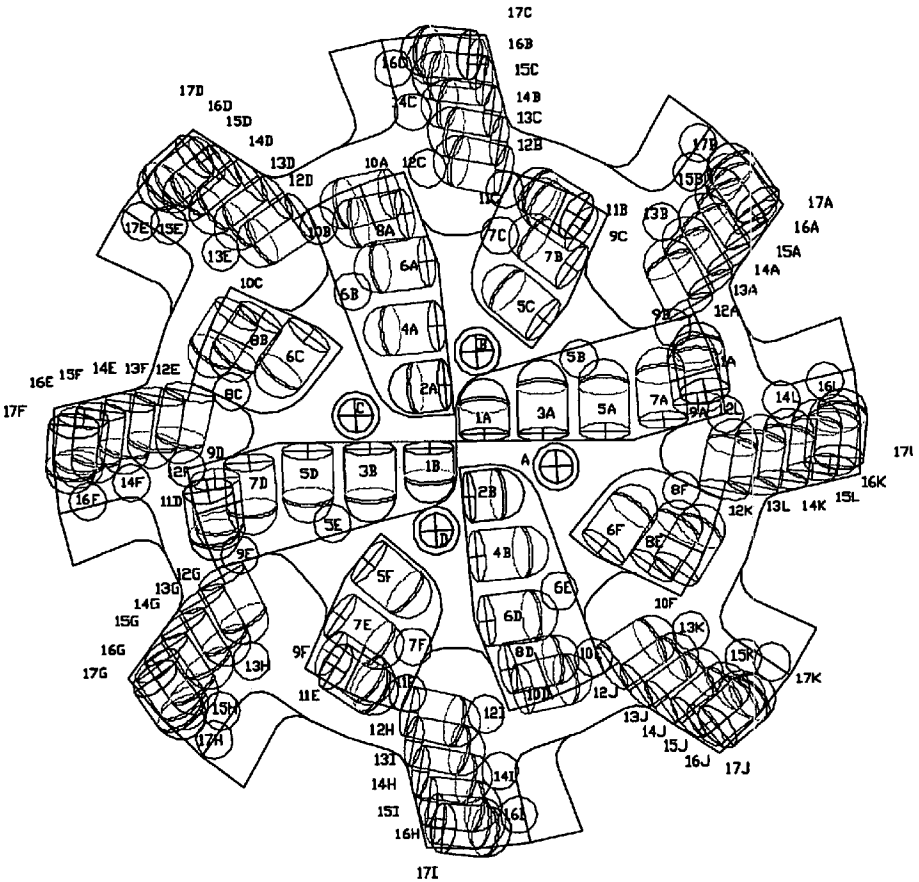
FIG. 11 depicts a face view of another embodiment of the invention disclosed and claimed herein.
Figure 12:
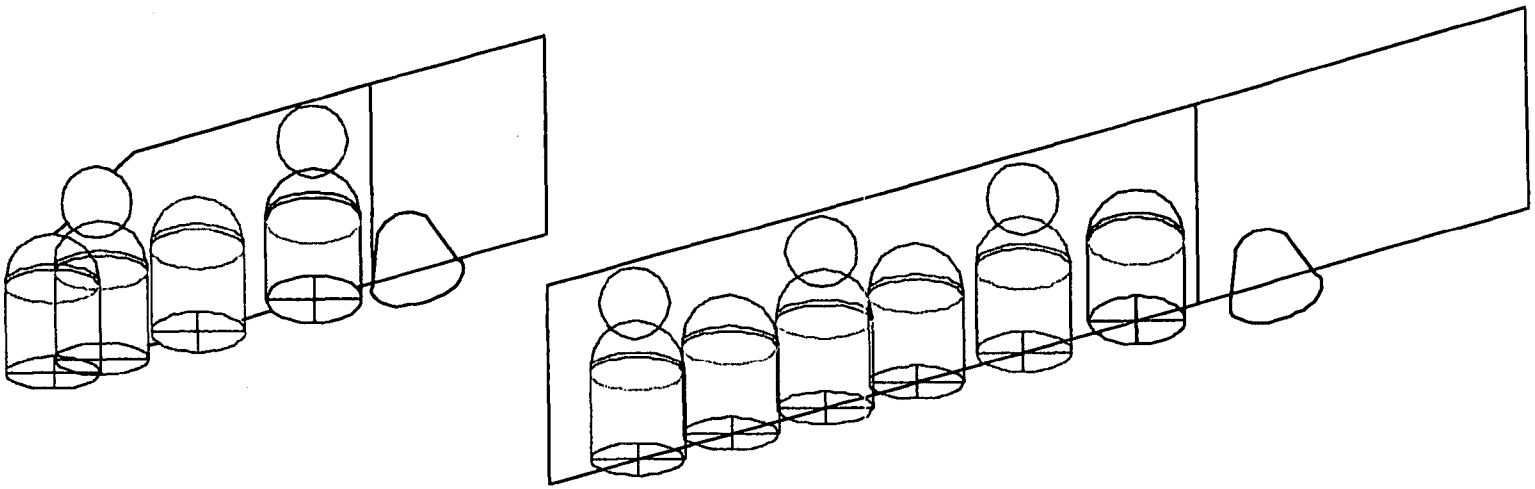
FIG. 12 depicts a side detail view of a cutting blade using the pilot and reamer alignment shown in FIG. 11.

Turning, now, to FIG. 11, there is depicted a face view of another embodiment of the invention disclosed and claimed herein. FIG. 12 depicts a side detail view of a cutting blade using the pilot and reamer alignment shown in FIG. 11.

With regard to the embodiment shown in FIG. 11 and FIG. 12, it should be understood that, in many embodiments of the present invention, a series of cutter elements on a blade in the pilot section will smoothly transition into a series of cutter elements on a blade in the reamer section, so that the two blades acting in combination act as a substantially integral blade unit. By contrast, however, in this FIG. 11 and FIG. 12, pilot blades and reamer blades of varying length alternate, all the while maintaining the net zero imbalance that characterizes this invention. This configuration aids in bit stability through gage wrap and also aids in the hydraulic cleaning of the tool.

Figure 13:
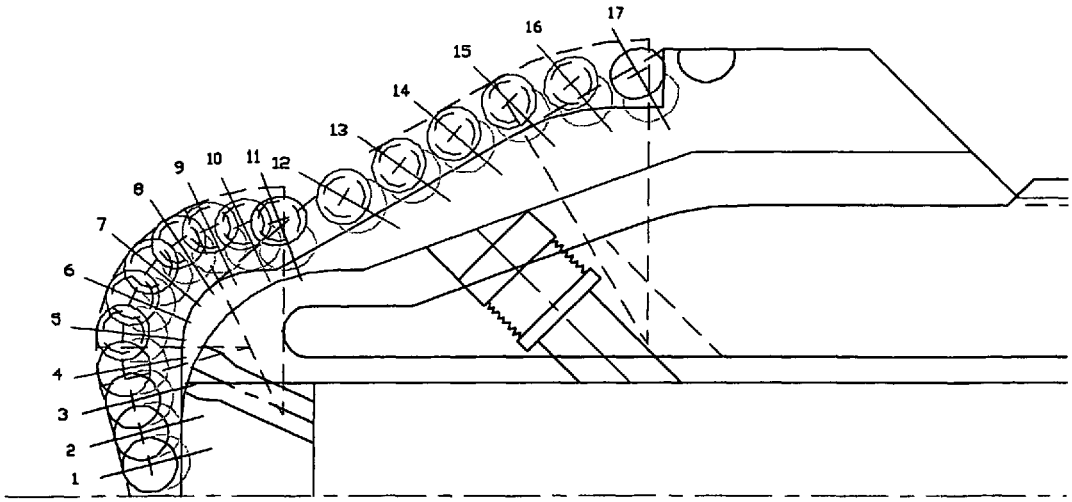
FIG. 13 depicts a quarter section rotated profile of another embodiment of the invention.

Turning, now, to FIG. 13, there is depicted a quarter section rotated profile of another embodiment of the invention. Notice in FIG. 13 the substantial absence of a heavily defined gage section between the pilot section and the reamer section. In certain applications, for example, this kind of variation in the design may well be desirable to affect the steer-ability of the drill bit where length of the drill bit is an issue.

Figure 14:
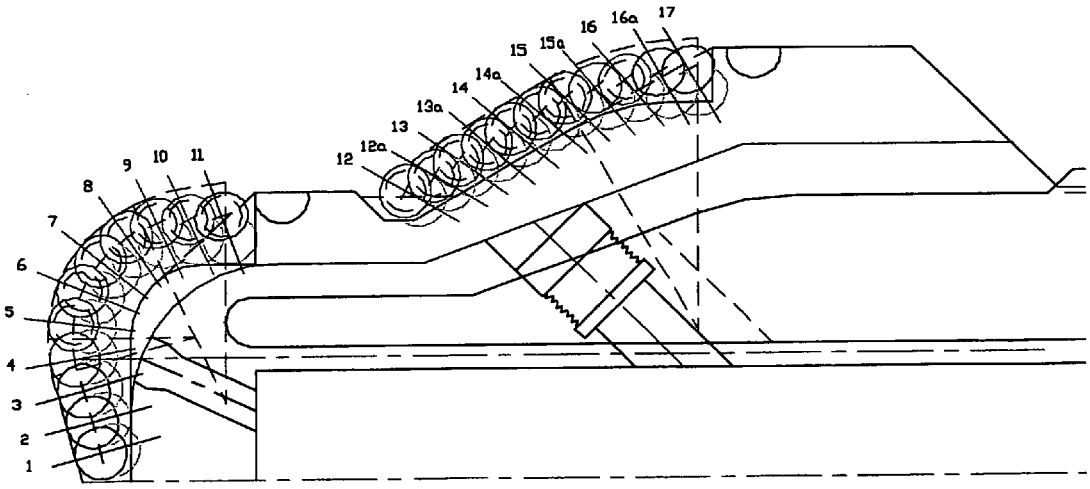
FIG. 14 depicts a quarter section rotated profile of another embodiment of the invention, an embodiment featuring reaming section cutting elements featuring adjacent cutter overlap.

Turning, now, to FIG. 14, there is depicted a quarter section rotated profile of another embodiment of the invention. In this embodiment, the reaming section cutting elements feature adjacent cutter overlap. Although the overlap exists, the reaming section still features the desired "stair step" profile.

Figure 15:
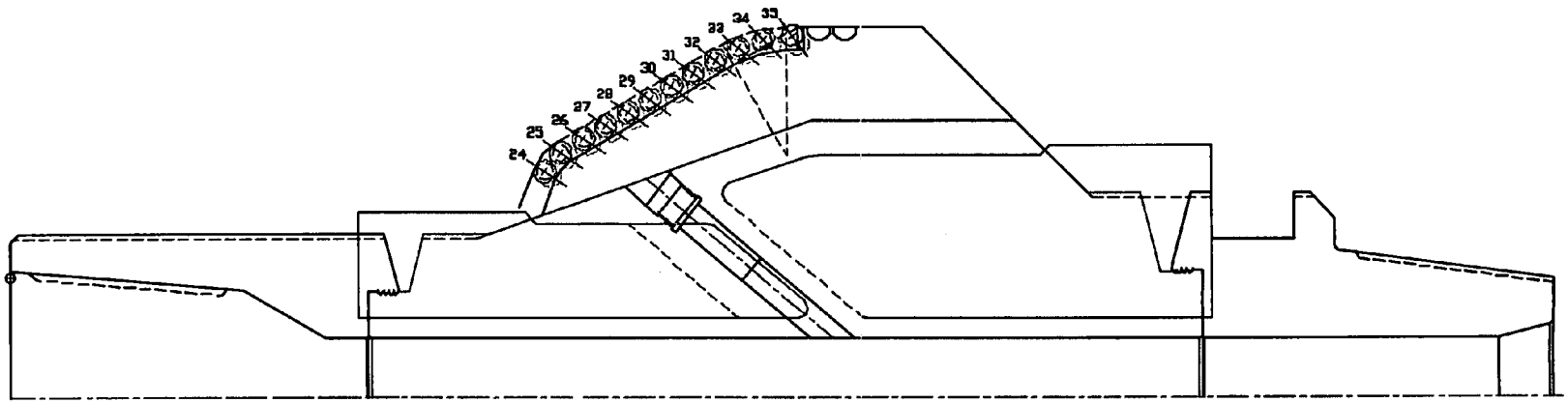
FIG. 15 depicts a quarter section rotated profile of a hole opener utilizing the novel reaming section disclosed herein.
Figure 16:
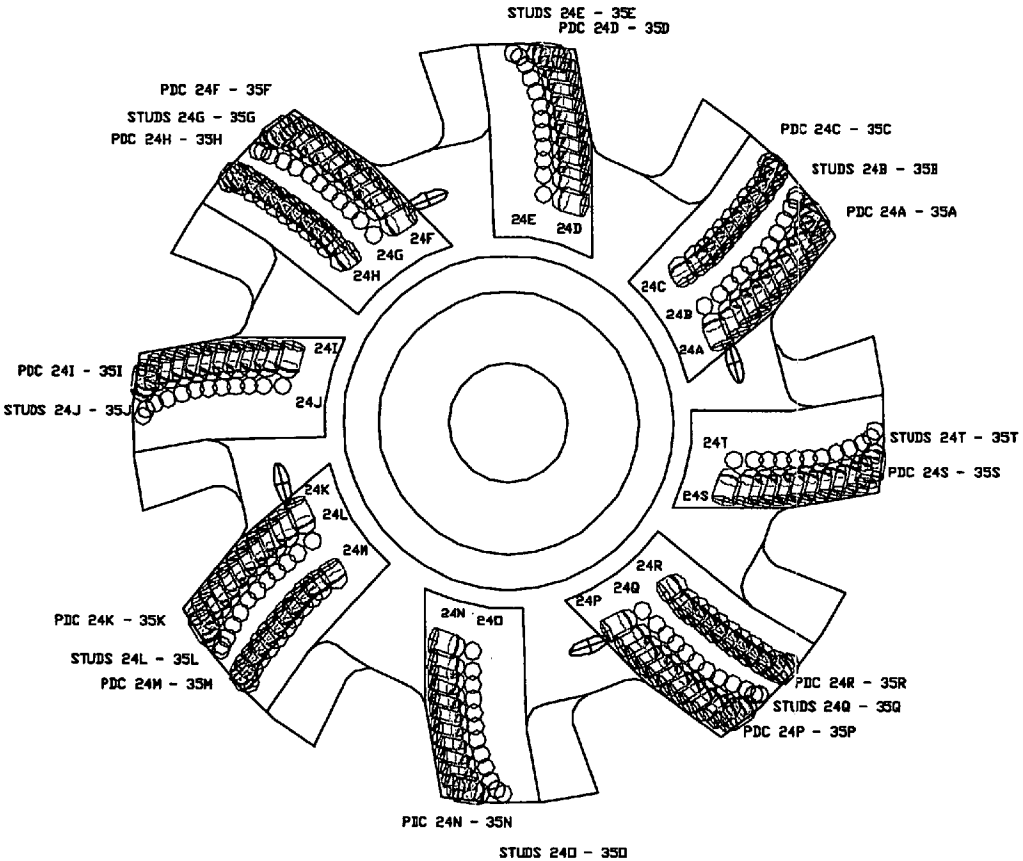
FIG. 16 depicts a face view of the novel hole opener reaming section shown in FIG. 15.

Turning, now, to FIG. 15, there is depicted a quarter section rotated profile of a hole opener utilizing the novel reaming section disclosed herein. FIG. 16 depicts a face view of the novel hole opener reaming section shown in FIG. 15.

The astute reader will appreciate from this disclosure generally, and from FIG. 15 and FIG. 16 specifically, that the invention described herein may be applied and used to improve the drilling performance of other tools commonly used for drilling or reaming earthen formations ("cutting structures"). For example, the teachings of the invention described hereinabove may be applied to cutting structures such as coring bits, bi-center bits, hole openers, under-reamers, and reaming stabilizers.

Although the invention has been described with reference to a number of preferred embodiments, this description should not be construed in a limiting sense. Rather, various improvements, modifications, and additions to the disclosed embodiments, which do not depart from the spirit and scope of the present invention, will become apparent to persons of ordinary skill in the art, and these improvements, modifications and additions, and their equivalents, should be viewed as being within the ambit of the invention as defined and claimed below.

We claim:

1. An earth-boring bit comprising:

a bit body having one end configured for connection into a drill string, a generally opposite cutting end, and defining a longitudinal axis;

a plurality of pilot section blades arranged in rows on the cutting end of the bit body, such that each pilot section blade opposes another pilot section blade;

a plurality of pilot section cutting elements arranged in rows on the pilot section blades such that each pilot section cutting element on one pilot section blade occupies the same radial and longitudinal position on the pilot section blade as a corresponding pilot section cutting element on the opposing pilot section blade;

a plurality of shock studs arranged on the pilot section blades rotationally trailing the pilot section cutting elements, the shock studs protecting the pilot section cutting elements against over-engagement with the formation;

a plurality of reaming section blades arranged longitudinally above the pilot section blades such that each reaming section blade opposes another reaming section blade, the reaming section blades defining a gage diameter larger than that of the pilot section blades;

a plurality of reaming section cutting elements arranged in rows on the reaming section blades such that each reaming section cutting element on one reaming section blade occupies the same radial and longitudinal position on the reaming section blade as a corresponding reaming section cutting element on the opposing reaming section blade; and at least one fluid nozzle arranged in the bit body such that upon disintegration of at least a portion of the plurality of reaming section blades, fluid flow through the fluid nozzle is restricted, indicating bit failure.

2. The earth-boring bit of claim 1, wherein a ratio of shock studs to pilot section cutting elements is about fifty percent in selected cutting element locations.

3. The earth-boring bit of claim 1, further comprising a plurality of shock studs arranged on the reaming section blades rotationally trailing the reaming section cutting elements.

4. The earth-boring bit of claim 3, wherein the cutting elements are arranged in groups and at least one shock stud is nested between groups.

5. The earth-boring bit of claim 3, wherein the reaming section cutting elements are arranged such that none of the reaming section cutting elements on one blade overlap the reaming section cutting elements on another reaming section blade.

6. An earth-boring bit comprising:

a bit body having one end configured for connection into a drill string, a generally opposite cutting end, and defining a longitudinal axis;

a plurality of pilot section blades arranged in rows on the cutting end of the bit body, such that each pilot section blade opposes another pilot section blade;

a plurality of pilot section cutting elements arranged in rows on the pilot section blades such that each pilot section cutting element on one pilot section blade occupies the same radial and longitudinal position on the pilot section blade as a corresponding pilot section cutting element on the opposing pilot section blade;

a plurality of shock studs arranged on the pilot section blades rotationally trailing the pilot section cutting elements, the shock studs protecting the pilot section cutting elements against over-engagement with the formation;

a plurality of reaming section blades arranged longitudinally above the pilot section blades such that each reaming section blade opposes another reaming section blade;

a plurality of reaming section cutting elements arranged in rows on the reaming section blades such that each reaming section cutting element on one reaming section blade occupies the same radial and longitudinal position on the reaming section blade as a corresponding reaming section cutting element on the opposing reaming section blade, and none of the reaming section cutting elements on one blade overlap the reaming section cutting elements on another reaming section blade; and at least one fluid nozzle arranged in the bit body such that upon disintegration of at least a portion of the plurality of reaming section blades, fluid flow through the fluid nozzle is restricted, indicating bit failure.

7. The earth-boring bit of claim 6, wherein a ratio of shock studs to pilot section cutting elements is about fifty percent in selected cutting element locations.

8. The earth-boring bit of claim 6, further comprising a plurality of shock studs arranged on the reaming section blades rotationally trailing the reaming section cutting elements.

9. The earth-boring bit of claim 6, wherein the cutting elements are arranged in groups and at least one shock stud is nested between groups.

* * * * *